United States Patent [19]

Shriver

[11] 4,167,740

[45] Sep. 11, 1979

[54] ONE MAN ANTENNA TOWER

[76] Inventor: James R. Shriver, Fisher Rd. - Box 526 - R.D. 1, Washington, Pa. 15301

[21] Appl. No.: 909,310

[22] Filed: May 24, 1978

[51] Int. Cl.[2] ..... H01Q 1/12; E04H 12/34

[52] U.S. Cl. ..... 343/882; 52/116

[58] Field of Search ..... 343/878, 879, 880, 881, 343/882, 883; 52/110, 116, 646

[56] References Cited

U.S. PATENT DOCUMENTS

| | | | |
|---|---|---|---|
| 485,883 | 11/1892 | Perry | 52/116 |
| 2,804,950 | 9/1957 | Leslie | 343/882 |
| 2,875,865 | 3/1959 | Rohn | 52/116 |
| 3,875,573 | 4/1975 | Bueckert | 343/882 |
| 3,977,139 | 8/1976 | Bryant | 52/116 |

FOREIGN PATENT DOCUMENTS

| | | | |
|---|---|---|---|
| 1283549 | 3/1961 | France | 52/116 |

OTHER PUBLICATIONS

Hill, Popular Mechanics, Sep. 1955, pp. 146–148.

*Primary Examiner*—Eli Lieberman
*Attorney, Agent, or Firm*—Parmelee, Miller, Welsh & Kratz

[57] ABSTRACT

A tower, mast or antenna support construction is provided that is easily swung by one person from an operative, fully upright, antenna-carrying position to a lower maintenance or repair position. It has a normally upright, central mast or column having a member assembly of securely endwise-connected members for, at its upper end, carrying an antenna and/or rotor motor therefor. A supporting frame or leg structure is adapted to be securely imbedded at its lower end in a ground level cement or concrete base to extend upwardly therefrom and swingably carry the column at a mid position therealong. An adjustable counterweight is carried by a hollow lower end portion of the column and is used to provide a substantial center of gravity balance of the column assembly at its swing axis when its antenna and/or rotor are in place, but with the upper end portion of the column assembly provided with a slightly greater effective weight or slight off-balance. Self-adjusting force equalization and controlled movement of the column under windy conditions is effected by cable or wires slidably strung through open ends of tensioning arms of a centrally carried, quadrant-shaped cross brace or spread frame.

9 Claims, 10 Drawing Figures

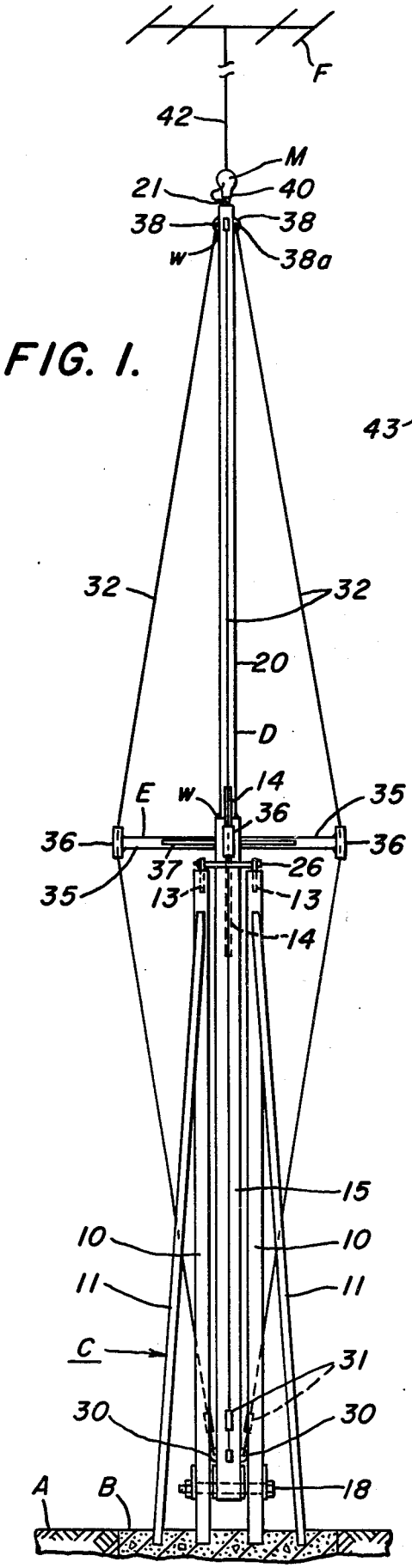
FIG. 1.
FIG. 7.
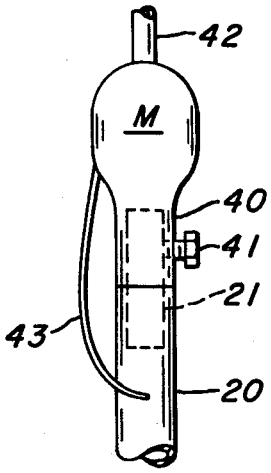
FIG. 6.
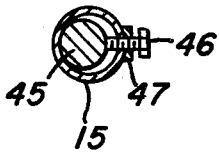
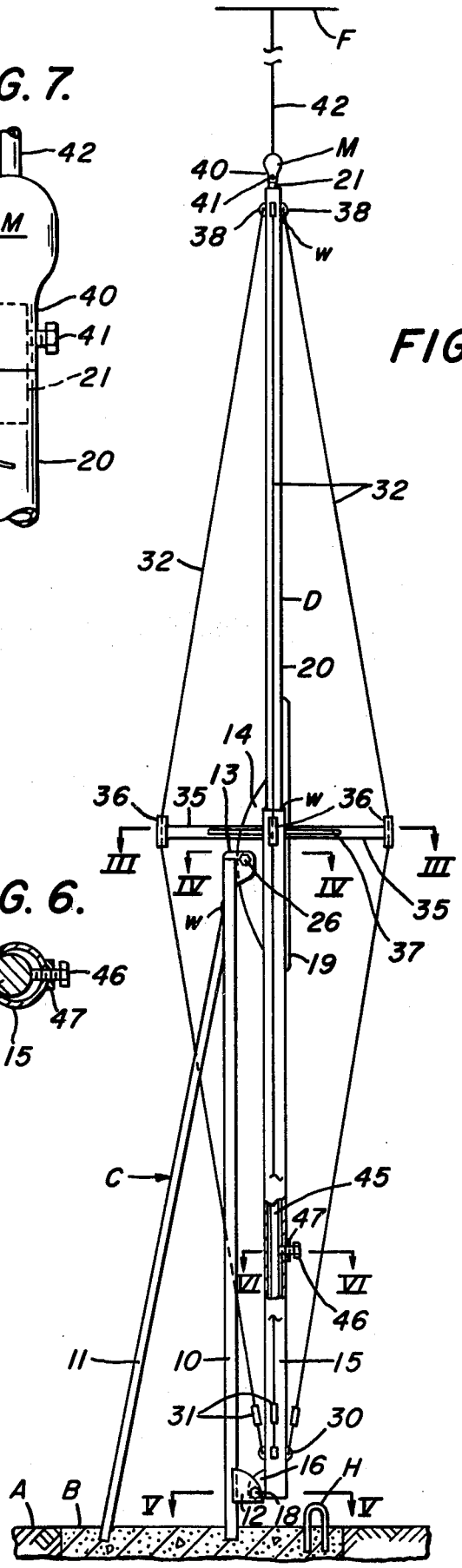
FIG. 2.

ONE MAN ANTENNA TOWER

BACKGROUND OF THE INVENTION

1. Field of the Invention

This invention relates to an inexpensive, fully practical, and highly improved mast or tower having a swingable antenna-carrying column and particularly, to one that after installation, will withstand high winds without buckling failure. A phase of the invention deals with a structure that is balanced in such a manner as to assure a full desired height with exceptional ability to withstand winds, and to enable a one-person "down" and "up" swinging of it for maintenance, change of antenna, etc.

2. Description of the Prior Art

Although so-called radio or antenna towers have been in use for a number of years, it has been my experience that those which are suited for maximum reception, for example, up to the sixty foot height limitation, have been too expensive from the standpoint of their construction and installation, and are difficult to service. During the bad weather of this year, I found that the prior art types tend to fail with winter wind gusts in the neighborhood of 65 to 75 miles/hour, leaving a mass of members and antenna wires. There has been a need for a relatively inexpensive, easily installed and maintained tower which will essentially withstand such wind gusts and which will enable a radio operator to, himself or herself, without the aid of others, service it from the standpoint of its antenna and rotor.

Types with which I am familiar employ a tower whose column is pivoted at a position that is located considerably below and at least not above a center portion of the length of its column, such that its actual center of gravity or tilt is located well above such a position. The center of tilt is also further upwardly advanced when an antenna and/or rotor are mounted on the upper end of the column. The length of the fixed support in such a construction may be only slightly more than the height of a person. For example, the total length above the ground may be about ten feet, as compared to a total upright length of column or mast of about sixty feet. It appears that the purpose in doing this has been to minimize the required length or height of supporting structure and to keep the swing point within the approximate reaching height of the arms of repairmen.

The great off-balancing of weight of the remaining fifty feet of the column plus the weight of the antenna and motor makes a down-swing of the column a somewhat dangerous operation, and although it is controlled by a cable and winch, the amount of control and manual force required for swinging the antenna to and retaining it in a lower maintenance "down" position and for moving it to and retaining it in an "up" position and while the winch is being latched, has been found to be such that at least two operators are required. The winch ratchet has to be retained in a locked position and presents a hazard, in that it is not foolproof and is subject to slippage or release, which may result in a violent downswing of the mast or column.

Other forms of towers have columns using demountable, interfitting members requiring complex, tent-like assemblies or guy wires. They have been found to be very expensive in their construction and of limited practicability from the standpoint of maintenance and repair, and from the standpoint of lack of resistance to damage under bad weather conditions. In other words, they will not withstand the vicissitudes of the ambient environment.

SUMMARY OF THE INVENTION

It has thus been an object of the invention to develop an improved swing type of tower column, mast or standard for a radio antenna or the like that will meet or eliminate difficulties that have been heretofor encountered in prior constructions.

Another object has been to develop an improved form of antenna tower that may make use of ordinary pipe, tubular and other metal members in an inexpensive arrangement that will be fully safe and practical in its utilization.

Another object of the invention has been to develop an antenna tower in which the center of tilt or gravity of its column may be easily adjusted with respect to its point of swivel or swing to compensate for different lengths and heights of the column and for the weight of an antenna or rotor carried thereby.

A further object of the invention has been to provide a tower that when mounted will withstand high velocity winds and very adverse weather conditions without failure, and which may be easily and safely swung by one operator from an "up" position to a desired "down" maintenance position and then, to an uppermost easily maintained, fixed position and without risk of life or limb to the operator.

A still further object of the invention has been to provide an antenna tower which is reinforced by a guy wire or cable assembly of substantially equalized force application, and that employs a tensioning quadrant frame in such a manner as to enable automatic compensation for bending force exerted by strong winds.

These and other objects will appear to those skilled in the art from the illustrated embodiment and the claims.

BRIEF DESCRIPTION OF THE DRAWINGS

FIG. 1 is a front elevation of a tower construction of the invention, showing it in a fully elevated, antenna-supporting position;

FIG. 2 is a side elevation of the construction on the same scale as and taken at a right angle with respect to FIG. 1;

FIG. 6 is a horizontal section on a further enlarged scale, taken along line VI—VI of FIG. 2, and illustrating adjustable counterweight means for a lower portion of the swing column;

FIG. 7 is a front fragmental elevation on the scale of FIG. 5, illustrating the mounting of an antenna rotor motor on an upper end of the swing column.

DESCRIPTION OF THE PREFERRED EMBODIMENT

Figure 8A:
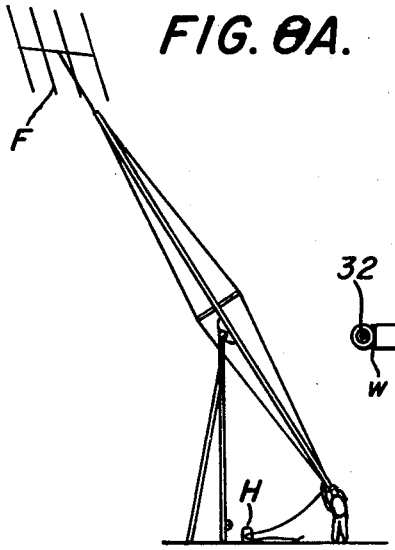
FIGS. 8A, 8B and 8C are somewhat diagrammatic or schematic views illustrating how the column may be safely and easily swung by one person from a normal upright position to a "down" position at which maintenance and repair of its rotor or antenna may be accomplished.

As shown in FIG. 1 of the drawings, a bottom support frame structure or assembly C of fixed mounting is provided, the lower end portions of whose leg pairs are at least semi-permanently secured in position within a mounting base B, such as of concrete or cement, that is set within the ground level A. Each leg pair of the support structure C is shown provided with a tubular, fully vertical, inner leg or support member 10 and a diagonal bar or strap-like, outer leg or support member 11. The fully vertical or upright leg members 10 have a transversely spaced-apart, opposed relation with respect to each other to confine a hollow or tubular, lower or primary column, mast or post member 15 of a central swing column or assembly D. The upper end of the column member 15 telescopically receives a lower, slightly smaller end of an upper tubular column member 20. The leg member 11 of each pair is an outer, diagonal member extending in an upward, inwardly converging manner from the mounting base B and, at its upper end, forming an apex with the upper end of its associated vertical leg member 10. A secure joint between abutting upper end portions of the members 10 and 11 may be provided by the use of weld metal w.

Figure 4:
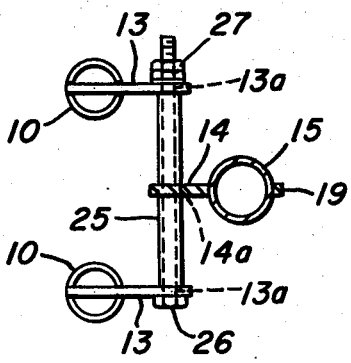
FIG. 4 is an enlarged horizontal section on the scale of FIG. 3, taken along line IV—IV of FIG. 2 and particularly illustrating details of a bottom latch assembly for an antenna-supporting swing column of the tower construction.
Figure 8C:
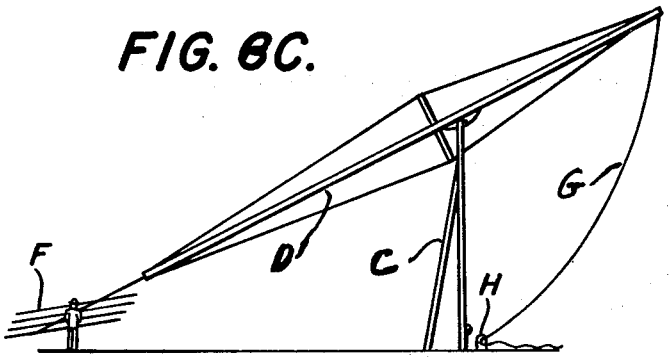

An inwardly extending swing flange or ear 13 constitutes an integral extension of the connected upper ends of the leg members 10 and 11, and has a swing hole portion **13*a* (see FIG. 4) therethrough to receive a through-extending swing bolt or pivot pin 26. A gusset plate 14 is weld-secured along one side of and across the joint between the pair of column members 15 and 20. As shown in FIG. 4, the swing or pivot pin 26 extends through a copper-bushed spacer collar or sleeve 25 that extends through hole 14*a* in the gusset plate 14, and across to abut oppositely positioned swing ears 13 of the support frame structure C. Swing bolt, pin or stem 26 may be threaded at its one end to receive a pair of position-locking nuts 27 thereon. The swing pin 26 may as shown be a bolt and nut assembly or a pin provided at its ends with a washer and cotter pin assembly. The spacer sleeve 25** serves to carry the column D in a mid or central pivotal or swingable positioning in the spacing between side-positioned opposed leg pairs of the support assembly C.

Figure 3:
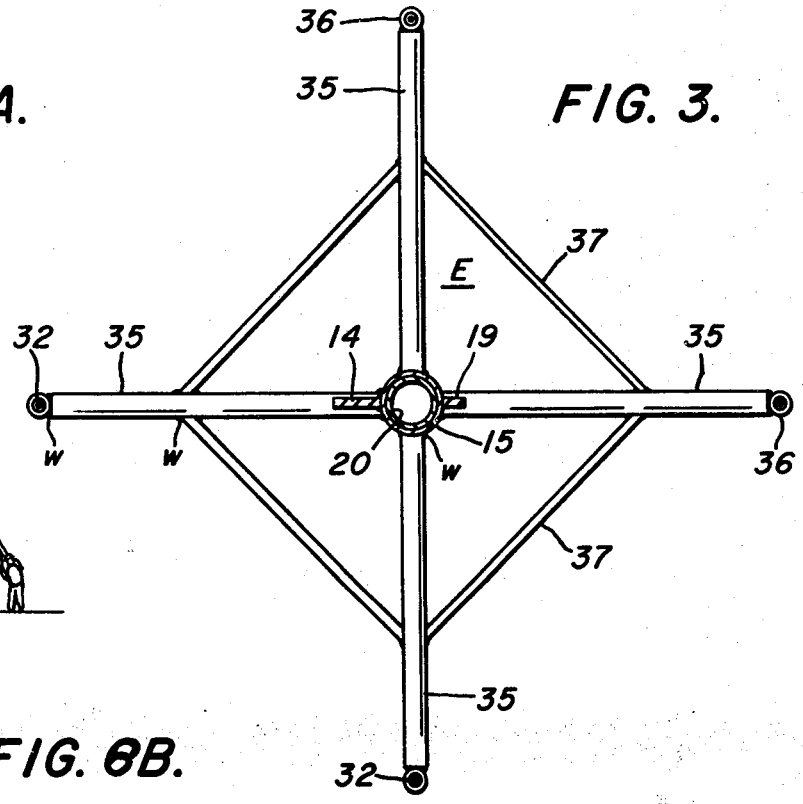
FIG. 3 is an enlarged horizontal section taken along the line III—III of FIG. 2 through a mid or somewhat central length portion of the tower construction, showing details of a force-equalizing, wire or cable tensioning frame.
Figure 8B:
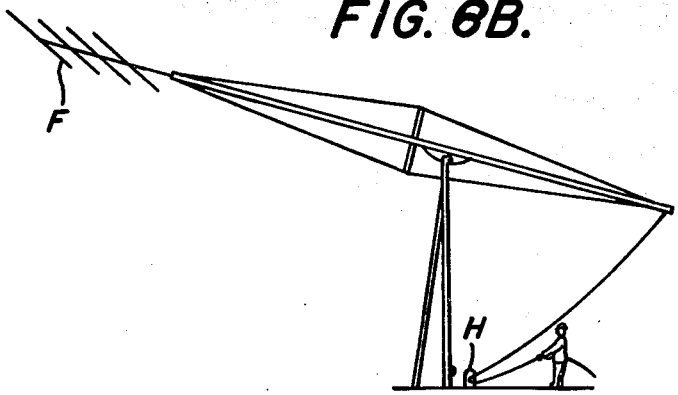

The joint between the two column members 15 and 20 is preferably made securely rigid, as by the use of weld metal w, and as strengthened by the cross-over mounting of the side-mounted gusset plate 14 and of an opposed side rib member 19 (see FIGS. 2 and 3). As shown, reinforcing metal rib member 19 is weld-secured to extend across the joint between the column members 15 and 20 and along a side that is opposite to the gusset plate 14.

Figure 5:
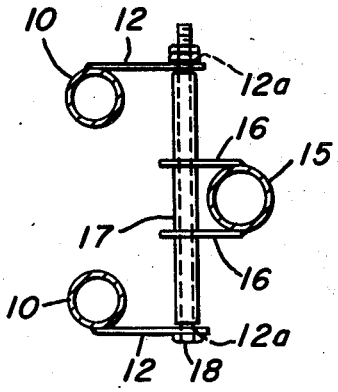
FIG. 5 is a horizontal section on the scale of FIG. 4, taken along the line V—V of FIG. 2, and particularly illustrating means for swingably mounting the column.

As illustrated particularly in FIGS. 2 and 5, each support leg 10 of the structure C has an outwardly projecting side flange or ear 12 that cooperates with a pair of opposed, projecting, bottom side flanges or ears 16 on the column 15 to receive a position-locking, latch pin or threaded bolt and nut assembly 18 through aligned hole portions **12*a*. The bolt or pin 18 is adapted to extend through a spacer sleeve or collar 17 on which the pair of ears 16 are secured, and between the pair of ears 12 to, in effect, removably retain or lock the lower column member 15 in a fully vertical position between the supporting leg members 10 of the structure C. When the upper end of mast or column D is to be swung downwardly to a maintenance or repair position (see FIGS. 6A, B and C), the bolt or pin 18 may be endwise-removed to release the lower end of the column member 15. Before doing this, however, it is preferable to tie or loop a piece of rope G over the ears 16 of the lower end portion of the column member 15 to serve as a control means for "down" swinging movement of the upper end of column D and to facilitate return of the column to a fully vertical position. Due to balancing adjustment of a counterweight 45**, the "pull" on the rope G that is required to swing the column D to its fully upright position is minimal.

The lower end of column member 15 of the central column D is provided with a series of four, equally spaced, connecting ears 30 (see FIGS. 1 and 2) secured thereto to project outwardly equidistantly from and about its circumferential wall. Tension guy wires or cables 32 are adapted at their lower ends to be connected to the ears 30 by adjustable turnbuckles 31. The four tension guys 32 extend upwardly in a spread relation to about the central portion of the substantially full extent of the column D, and then through end-positioned, vertically open, guide collars, sleeves or eyes 36 of an associated transversely horizontally outwardly extending arm 35 of a quadrant stretcher, spread or tensioning frame E (see FIG. 3). It will be noted that the arms 35 of the frame E are quadrant-positioned, outwardly projecting, tubular members that are rigidly secured at their inner ends to the column member 20 and are cross-connected and reinforced by bracing, strap-like members 37.

The uppermost ends of the tension guy wires or cables 32 are connected to an upper end of column member 20 by outwardly projecting ears or lugs 38 that are secured by weld metal w to the column member. As shown in FIGS. 1 and 7, a pin shaft 40 is secured to project upwardly from within the column member **20*a* for mounting an antenna F and, if desired, an antenna rotator motor M thereon. An electric current-carrying cable 43 may extend from the motor M through a hole in the member 20 down along the inside of the members 20 and 15 for connection at its lower end to a suitable source of electric energy (not shown). An elongated, cylindrical counterweight 45 of, for example, a solid heavy metal, such as lead, brass, cast iron, or of a cast cement shape, is slidably positioned within the interior of the lower column member 15 for slidably adjustable positioning therein. A threaded set screw or bolt 46 is mounted to extend in a threaded relation through a wall of the lower column member 15 and a boss 47 (see FIG. 6) to lock the counterweight 45** in a selected, slidably adjusted position.

The use and positioning of the counterweight 45 within the lower column member 15 is a highly important feature of the invention from the standpoint of balancing the mast or column D with respect to its swing axis as represented by the pin shaft 26. It is only necessary in constructing the tower to approximate the center of tilt or gravity of the assembly of column members 15 and 20, since after an antenna G and/or rotor motor M have been mounted, the person erecting the tower may then adjust the counterweight 45 so as to substantially balance the resulting respective weights of the column parts or members 15 and 20 with respect to each other. After this is done, swinging of the column D is an effortless one-person operation, and can be easily controlled without any danger of injury to the operator.

As previously intimated, an operator desiring to swing the upper end member 20 of the column D to a "down" position for servicing its antenna F, may first attach the end of a rope G (see FIG. 6A), to the lower end of the column member 15 and, if desired, thread it through a metal eye or loop member H that is shown (see FIG. 2) imbedded in the base B. Then, after latching bolt 18 is endwise-removed, upswing of the lower end of member 15 can be easily controlled (see FIGS. 6A, B and C) to permit the upper end of column member 20 to swing under the force of a portion of its own weight to a desired "down" position. In this connection, the counterweight 45 may be set at a position such that there is a slight weight off or over-balance towards the upper column member 20. Thus, one person may easily accomplish antenna or rotor maintenance, as contrasted to the need for two or three persons in a conventional tower construction. Also, the need for reliance on a winch and ratchet latch mechanism has been eliminated.

The spread frame E and wire or cable 32 assembly has been proven to be highly effective in providing a flexible tensioning of the column D such that a tower of my construction has remained in an undamaged condition, while those of conventional constructions were reduced during this winter's storms to a mass of bent metal. The opposed, four-way equalized, centrally spread positioning of the wires 32, plus the use of open-end tensioning tubes, eyes or sleeves 36 to permit an automatic slidable adjustment of the relation between tensioning arms 35 and the wires 32, was found to be the answer to the problem which has heretofore been encountered with high winds.

I claim:

1. In a tower construction having a swingable central mast for carrying an antenna at its upper end and having an upright support structure to be ground level embedded for carrying the central mast, the improvement which comprises, a longitudinally extending column defining the central mast, a lower portion of said column being adapted to be positioned along the support structure to extend longitudinally thereof, said column having a gusset plate secured to extend from a side thereof at a mid position therealong, swing support means carried by an upper end of the support structure, swing pivot means cooperating with said gusset plate for operatively mounting said column in a swingable relation on said swing support means, a first latching ear means carried by a lower end portion of said column, a second latching ear means carried by a lower end portion of the support structure, a latch pin adapted to cooperate with said first and second latching ear means for retaining said column in an upright position along the support structure, said latch pin being removable from said first and second latching ear means to release said column for swinging movement on said gusset plate about said swing support means of the support structure, counterweight means slidably adjustably carried by the lower portion of said column for adjusting the center of gravity of the length of said column to accommodate its swing mounting with respect to the support structure to provide a slight off-balancing of an upper portion of said column about said swing pivot means when said column is to be swung with respect to the support structure, the lower portion of said column being of hollow tubular construction, said counterweight means being of solid heavy metal construction and being slidably adjustably carried within said lower portion of said column for longitudinal movement therealong, and means mounted on said lower portion thereof for securing said counterweight means in a selected adjusted relation with respect to said column.

2. A tower construction as defined in claim 1 wherein, the support structure has a pair of spaced-apart support frames for mounting in a fixed base to extend in an opposed spaced-apart relation along opposite sides of the lower portion of said column, and each of said support frames has an inner vertical upright member and an outer diagonally extending support member that extends upwardly in a converging relation with respect to and is secured at its upper end to its associated vertical upright member.

3. A tower construction as defined in claim 1 wherein, a spread frame is secured to project transversely from said column at a mid position therealong and has arms defining a cruciform shape, and a group of cables are secured at their opposite ends to upper and lower end portions of said column to extend through outer ends of said arms in a slidably adjustable tensioned relation with respect thereto.

4. A tower construction as defined in claim 3 wherein, said spread frame has a collar centrally secured on said column adjacent to and above said gusset plate, a reinforcing rib is secured to extend along said column on an opposite side thereof with respect to and in substantial alignment with said gusset plate, and each arm of said spread frame has a vertically open sleeve through which an associated one of said cables extends.

5. A tower construction as defined in claim 1 wherein, said column has a group of tubular members in a telescopically endwise securely connected relation with respect to each other therealong, guy wires are connected between opposite ends of said column, and an intermediately positioned spread-tension frame is secured on said column to extend transversely thereof and slidably maintain said guy wires in a balanced outwardly spread adjustably tensioned relation with respect thereto and therealong.

6. A tower construction as defined in claim 5 wherein said spread-tension frame positions said guy wires in an equally spaced outwardly spread mid position with respect to and along said column.

7. A tower construction as defined in claim 1 wherein, a spread frame having four quadrant-positioned equal-length arms is secured to extend transversely from said column at a mid position with respect to opposite ends thereof, a group of four cables are secured at their opposite ends to upper and lower ends of said column, and each of said cables extends in an endwise-slidable-tensioned relation on an outer end of an associated one of said arms.

8. In a tower construction having a swingable central mast for carrying an antenna at its upper end and having an upright support frame structure for carrying the central mast, the improvement which comprises, a tubular longitudinally-extending column member assembly defining the central mast, a pair of upright support frames defining the support structure, swing means swingably mounting a mid portion of said column member assembly between and on upper end portions of said pair of upright support frames for swingable movement between a fully vertical "up" position and a horizontal to off-horizontal "down" position, means for substantially balancing said column member assembly with respect to and on said swing means in such a manner that an operator may effectively raise and lower an uppr portion of said column member assembly about said swing means by manual force applied to a lower portion of said column member assembly, latch means cooperating with lower portions of said column member assembly and said pair of upright support frames for detachably securing said column member assembly in a fully upright position between and along said pair of support frames, a centrally closed-off quadrant-shaped spread frame secured to project transversely from a mid portion of said column member assembly and having four arms secured at their inner ends to said column assembly and projecting transversely therefrom in an equally spaced-apart relation, open-end guide means secured to the outer end of each of said arms and being open in the direction of longitudinal extension of said column member assembly, a guy wire for each of said arms, and each said guy wire being secured at its opposite ends between upper and lower ends of said column member assembly and extending slidably through an associated one of said guide means of said spread frame for maintaining it in a slidably tensioned relation along said column member assembly.

9. A tower construction as defined in claim 8 wherein, adjustable counterweight means is carried by said column member assembly adjacent a lower end portion thereof for adjusting the distribution of weight thereof to a slightly off-balanced relation towards its upper end portion from said swing means, said column member assembly has a lower column member of hollow construction, said means for substantially balancing said column member assembly is a metal counterweight slidably adjustably positioned within said lower column member for movement therealong, and set screw means is carried by said lower column member to securely engage and retain said counterweight in an adjusted position with respect thereto.

* * * * *